United States Patent [19]

Heinen

[11] 4,160,421

[45] Jul. 10, 1979

[54] FIRE DOOR ASSEMBLY

[75] Inventor: Hans D. Heinen, Malmedy, Belgium

[73] Assignee: Intellectual Trade Cy S.A., Grand-Duche de Luxembourg, Luxembourg

[21] Appl. No.: 835,921

[22] Filed: Sep. 23, 1977

[30] Foreign Application Priority Data

Sep. 24, 1976 [BE] Belgium ..... 75867

[51] Int. Cl.[2] ..... F23M 7/00

[52] U.S. Cl. ..... 110/173 R; 49/485; 202/248; 126/190; 126/194

[58] Field of Search ..... 110/173 R; 202/248; 126/190, 198, 194; 49/485; 432/250, 252

[56] References Cited

U.S. PATENT DOCUMENTS

| | | | |
|---|---|---|---|
| 300,137 | 6/1884 | Saxe | 110/173 R |
| 1,444,013 | 2/1923 | Thomas | 126/190 |
| 2,192,231 | 3/1940 | Klute | 126/194 |
| 2,327,541 | 8/1943 | Matheny | 126/190 |
| 2,584,404 | 2/1952 | Webb | 126/194 |
| 3,666,904 | 5/1972 | Krajewski | 126/190 |
| 4,077,389 | 3/1978 | Vogel | 126/190 |

*Primary Examiner*—Henry C. Yuen

*Attorney, Agent, or Firm*—Sughrue, Rothwell, Mion, Zinn and Macpeak

[57] ABSTRACT

A fire door assembly for providing access to an enclosed space such as a furnace, fireplace, duct, tank or cistern including a movable flap having peripheral portions which can be positioned flush against a wall so as to close an access opening. A gasket or seal is provided along the access opening on the face of the outer wall.

3 Claims, 3 Drawing Figures

FIRE DOOR ASSEMBLY

The present invention relates to a door for providing access to an enclosed space such as a furnace, fireplace, duct, tank or a cistern.

Briefly, the door in accordance with the invention comprises a movable flap that can be positioned against a wall so as to close an access opening provided in the wall with a gasket or seal extending around the access opening.

In doors of this general type of known construction, the flap normally includes a metal frame whose interior is provided with a body of refractory material. The metal frame of the flap extends laterally along the entire thickness of this flap. The metal frame of the flap includes a projecting section directed toward the interior of the enclosed space in the closed position of the flap.

Also, in prior art constructions, the access opening is defined by a jamb formed by a metal section extending along the entire thickness of the wall and thus extending between the outside and inside faces thereof. The metal section of the jamb has a flange upon which the gasket is mounted.

When the flap of prior art doors is in the closed position, the projecting part of its metal frame alone is fitted in the access opening and rests against the gasket mounted upon the flange of the metal section of the jamb.

Such prior art doors have numerous deficiencies.

As metal parts extend continuously on both sides of the gasket between the inside and outside faces of the wall through the access opening, the flames and hot gases coming from the interior of the enclosed space lick and scorch these metal parts. Hence, the gasket is subject to considerable heating which reduces its fire resistance. Moreover, if the heat in the interior of the enclosed space increases suddenly, intense heat is transmitted from the interior to the exterior of this enclosed space reducing all the more the thermal efficiency of the doors. Thus, the doors of known construction have a relatively limited fire resistance.

Furthermore, due to the presence of the projecting part of the flap positioned in the access opening in the closed position, the construction of the flap must make allowance for factory tolerances of the jamb provided in the access opening. Therefore, the previously known doors were very often required to be of special construction.

SUMMARY OF THE INVENTION

An object of the invention is thus to provide a better door of the above-mentioned type having a markedly improved fire resistance and being at the same time easier and less expensive to manufacture than the already known small doors.

To this end, in the door designed in accordance with the principles of the invention, the gasket is mounted solely on the outside face of the wall. As a result, the flap of the door of the invention can be completely flat and its construction can be virtually independent of the factory tolerances of the access opening. Moreover, the side walls of the access opening may continue to be made of brickwork, refractory material, or thermally insulating material without requiring any metal jamb whatsoever. These factors explain the superior fire resistance of the new door as opposed to the conventional doors.

In the door of the invention, the gasket is preferably mounted flat against the outside face of the wall.

In the embodiment in which the door of the invention comprises a flap formed by a metal frame containing a body made from a thermally insulating material, the portion of the face of the flap lying inside the zone of contact between the inside face and the gasket is formed only by the body of thermally insulating material. Thus, in practice, the frame of the leaf includes a single plate, the edges of which are turned over twice at right angles in the same direction so as to form inner wings that can be pressed against the gasket without passing beyond the latter towards the access opening.

In the embodiment in which the door of the invention includes a jamb which is mounted on the wall around the access opening, the jamb is formed by a folded plate having a base that can be pressed flat against the outside face of the wall with the gasket between the two. In this case, the height of the jamb corresponds substantially to the thickness of the leaf.

The fulfillment and other objects of the present invention will be apparent from the detailed description of the invention given in connection with the various figures of the drawing which represent schematically and merely by way of example a specific embodiment of the invention.

BRIEF DESCRIPTION OF THE DRAWINGS

FIG. 2 is a partial cross-sectional view of the door of FIG. 1 taken from the side of its hinges, while

DESCRIPTION OF THE PREFERRED EMBODIMENTS

Figure 1:
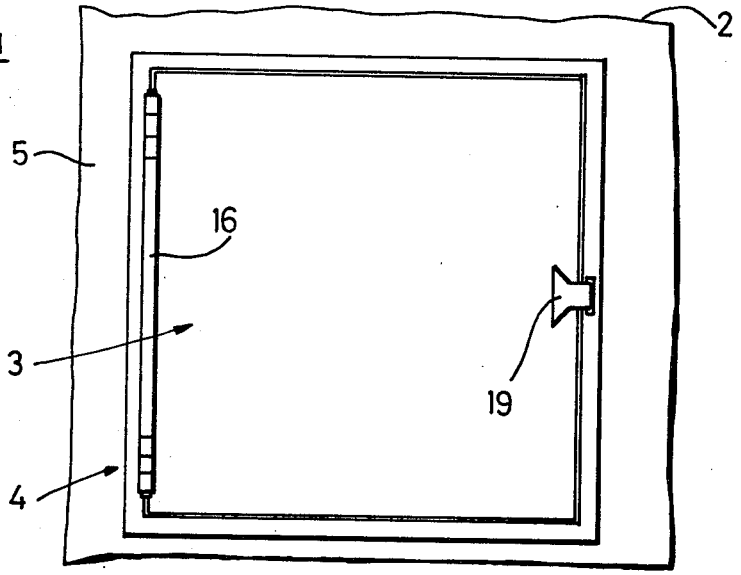
FIG. 1 is a front elevational view of a fire door designed in accordance with the invention.

The door shown serves to provide the access to opening 1 in a wall 2 of a furnace. The door is fire-proof so as to prevent or at least retard the spread—toward the exterior of the furnace through the access opening, of the fire and hot gases produced in the enclosed space of the furnace. The door of the invention may also be utilized to equip an access opening provided in a wall of a fireplace, duct, tank or cistern.

Briefly, the small door comprises a flap 3 which can move and swivel in relation to the wall 2. To this end, the flap 3 is mounted on a jamb 4 attached to the outside face 5 of the wall 2 around the access opening 1. In the closed opening, the flap 3 lies opposite the access opening 1 parallel to the outside face 5 of the wall 2 and is fitted in the jamb 4.

In the example shown, the flap 3 includes a metal frame formed by a steel plate 6, the edges of which are turned over twice at right angles unidirectionally. The plate 6 thus includes a full outside portion 7 forming the front face of the flap 3, lateral wings 8 forming the lateral faces thereof and extending along the entire thickness of the flap and comparatively narrow inside edges 9 parallel to the outside portion 7. The metal frame of the flap 3 serves as a support for a body 10 of insulating material such as compressed asbestos cement. It should be noted that the inside edges 9 of the plate 6 are all located beyond the access opening 1 so that only the body 10 of insulating material faces this access opening 1 in the closed position of the leaf 3. Therefore, only the body 10 of insulating material of the flap 3 is subject to the action of the fire and hot gases produced in the enclosed space of the furnace.

Figure 3:
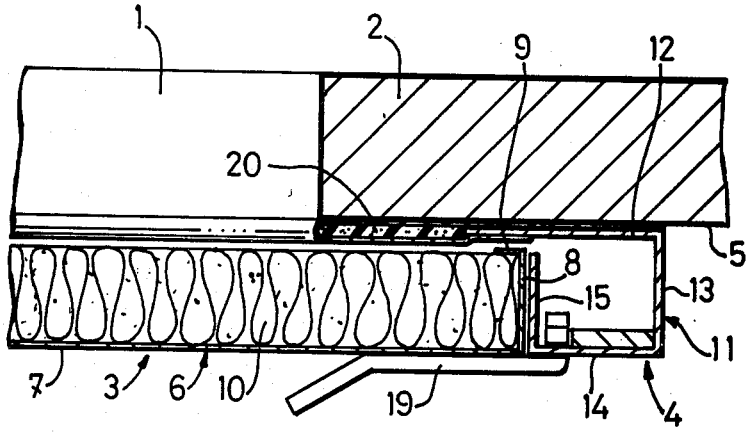
FIG. 3 is a similar view taken from the opposite side.

The jamb 4, in turn, is formed by a metal frame made up of sections 11 of a folded steel plate, as particularly illustrated in FIG. 3. Each section 11 comprises a base 12 pressed flat against the outer face 5 of the wall 2 and attached thereto by conventional means. The section 11 also includes a wing 13 jutting out in relation to the base 12 and having a width substantially corresponding to the thickness of the flap 3. The section 11 also comprises another wing 14 parallel to the base 12 and somewhat smaller than the wing 13. The section 11 finally has a free edge 15 extending toward the base 11 parallel to the wing 13 and somewhat smaller than the latter.

The flap 3 is mounted in such a manner as to pivot on the jamb 4, using conventional hinges 16, one hinge 17 being attached to the wing 8 of the metal frame of the flap 3 and the other hinge 18 being interlocked with the wing 14 of the metal frame of the jamb 4.

The flap 3 is actuated by a handle 19 joined to the external part 7 of its metal frame and inserted in a corresponding opening of a wing 14 of the metal frame of the jamb 4.

In accordance with the inventive concept, the small door is provided with a gasket 20 mounted flat only against the outside face 5 of the wall 2 around the access opening 1.

Figure 2:
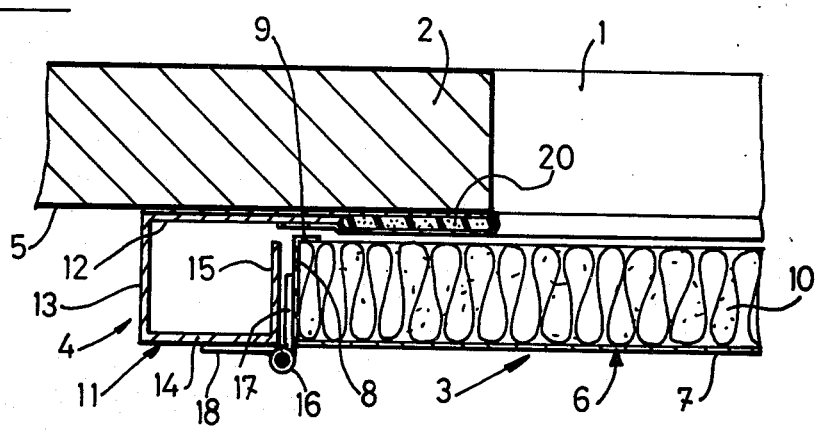

In the case under consideration, the gasket 20 is made of flexible and flat wrapping containing an expandable material such as sodium silicate. The cross section of the gasket 20 is illustrated in FIGS. 2 and 3.

In the example shown, the gasket 20 is held in position against the outside face of the wall 2 by at least one element of the metal jamb, in this case by the base 12. However, in a variant the gasket may be attached to the wall by conventional mounting elements without requiring a jamb.

In the closed position, the inside face of the leaf 3 rests continuously against the gasket 20 over the peripheral portion of the body 10 made from a thermally insulating material and, where necessary, the inside edges 9 of the metal frame. Consequently, there is no metal part in the areas of the small fire door in the closed position exposed to the fire and hot gases produced in the enclosed space of the furnace. Therefore, the fire door of the invention, as a whole, has a high fire resistance.

The gasket 20 may have a shape and a composition that are different from those of the example described herein.

Although certain preferred embodiments of the invention have been disclosed for purposes of illustration, it will be understood that various omissions and substitutions and changes in the form and details of the device illustrated and its operation may be made by those skilled in the art without departing from the scope and spirit of the invention. It is the intention, therefore, to be limited only as indicated by the scope of the appended claims.

I claim:

1. In a fire-proof small door assembly for providing access to an enclosure such as a furnace, duct, tank, cistern or the like, the combination comprising:

(a) a fixed frame mounted on a wall of the enclosure around an access aperture in said wall and comprising a metal plate, said metal plate having a flat base positioned against the outer face of said wall around said aperture and secured to said outer face and two flanges, the first one of said flanges projecting perpendicularly from the base and the second of said flanges projecting perpendicularly from the first flange;

(b) a flat seal mounted on said outer face of said wall around said aperture partially between said wall and said base of said fixed frame;

(c) a door flap comprising a casing formed from a metal plate having edge portions which are bent twice at right angles in the same direction, said casing containing a block of insulating material, said block being continuously applied against said seal in the closed position of said door flap; and (d) means connecting said door flap with said fixed frame.

2. A fire-proof small door assembly as claimed in claim 1, wherein the height of said fixed frame is substantially equal to the thickness of said door flap.

3. A fire-proof small door assembly as claimed in claim 1, wherein said flat seal comprises a flexible and flat wrapping containing an expandable material.

* * * * *